US010202805B2

(12) United States Patent
Surdo

(10) Patent No.: US 10,202,805 B2
(45) Date of Patent: Feb. 12, 2019

(54) ROOF MOUNTED LADDER SAFETY BRACKET

(71) Applicant: Leonardo Surdo, Brooklyn, NY (US)

(72) Inventor: Leonardo Surdo, Brooklyn, NY (US)

( * ) Notice: Subject to any disclaimer, the term of this patent is extended or adjusted under 35 U.S.C. 154(b) by 206 days.

(21) Appl. No.: 15/176,571

(22) Filed: Jun. 8, 2016

(65) Prior Publication Data

US 2017/0356245 A1 Dec. 14, 2017

(51) Int. Cl.
*E06C 7/48* (2006.01)

(52) U.S. Cl.
CPC ..... *E06C 7/488* (2013.01)

(58) Field of Classification Search
CPC ..... E06C 7/488
See application file for complete search history.

(56) References Cited

U.S. PATENT DOCUMENTS

| | | | | |
|---|---|---|---|---|
| 3,568,801 | A | 3/1971 | Werner | |
| 4,331,217 | A | 5/1982 | Stecklow | |
| 4,369,860 | A | 1/1983 | Beane | |
| 4,502,566 | A | 3/1985 | Wing | |
| 4,615,412 | A | 10/1986 | Clarke | |
| 4,823,912 | A | 4/1989 | Gould et al. | |
| 5,010,979 | A | 4/1991 | Shreve, III | |
| 6,932,191 | B1 | 8/2005 | Schwenk | |
| 6,994,188 | B2 | 2/2006 | Hockensmith | |
| 8,235,175 | B1 * | 8/2012 | Feldhaus | 182/106 |
| 2005/0045421 | A1 * | 3/2005 | Gaines | E06C 1/36 182/107 |
| 2007/0278037 | A1 | 12/2007 | Michel et al. | |
| 2013/0284870 | A1 | 10/2013 | Deal et al. | |
| 2015/0027812 | A1 | 1/2015 | Budziak et al. | |
| 2015/0068839 | A1 | 3/2015 | Webster et al. | |
| 2015/0129356 | A1 | 5/2015 | Strawder | |
| 2015/0337596 | A1 | 11/2015 | Cherevko et al. | |

OTHER PUBLICATIONS http://www.femo.com.au/products/roof-safety-access/roof-safety-signage/hi-safe-ls25g-ladder-bracket-gutter, published at least from Mar. 12, 2012, printed on Apr. 29, 2016.

* cited by examiner

*Primary Examiner* — John C Hong
(74) *Attorney, Agent, or Firm* — Cowan, Liebowitz & Latman, P.C.; JongChan Daniel Kang

(57) ABSTRACT

A roof mounted ladder safety bracket comprises a first plate, a second plate, a third plate, a first hinge and a second hinge. The first plate and the second plate are rotably coupled via the first hinge and the second plate and the third plate are rotably coupled via the second hinge. The first plate further comprises a plurality of arms extending therefrom, each of the plurality of arms comprises thereon at a distal end, a hook having an open end facing outward in a first direction and the open end of the hook is configured to be temporarily attached to a leg of a ladder. The third plate further comprises at least one opening configured to enable the ladder safety bracket to be temporarily coupled to a roof structure. The roof mounted ladder safety bracket secures to the ladder via the open end of the hook by using a locking mechanism and secures to the roof structure via the at least opening by nailing a nail through a portion of the at least one opening.

15 Claims, 7 Drawing Sheets

ROOF MOUNTED LADDER SAFETY BRACKET

FIELD OF INVENTION

The present invention relates to ladder safety brackets and more particularly to a bracket that is easily attachable and removable from a ladder and also mountable on a roof of any angle.

BACKGROUND

Ladders are frequently used in performing construction or repair tasks on the roof of a house or a building. Typically, a ladder rests against a sidewall or an edge of the roof and a user climbs the ladder to perform tasks at high altitudes. Inherent danger of such usage is that without additional support, the ladder may slide, move or tip over causing the user on the ladder to fall off and incur serious injuries. Such household and construction accidents are frequent each year.

To increase stability, many ladders are used with stabilization devices. For example, conventional ladder stabilization devices include ladder support attachments having one end with hooks or brackets that enclose the rungs or legs of a ladder while the other end engages with the roof, either mounted to shingles of the roof or arched over an apex of the roof structure. Other ladder stabilization devices come with ropes or strings that are tethered to a worker's waist to prevent the worker from falling off the ladder. Such conventional stabilization devices provide increased stability for workers on ladders or workers maneuvering from a ladder to the roof of a structure.

However, conventional ladder stabilization devices are generally complex in design and they tend to require complicated installation processes for securing the stabilization devices to the roof before they can be used in place. Moreover, once such device is securely installed on the roof, it is often difficult to uninstall the device once the task is complete. Furthermore, the installation and uninstallation processes may require the user to use additional tools that need to be brought up and down the ladder each time such devices are being used.

SUMMARY OF THE INVENTION

It is an objective of the present invention to provide an easily mountable and removable ladder safety bracket that is simple in design yet durable and adjustable to roofs of any angle, and securely attachable to ladders or other climbing means. It is a further objective of the present invention to provide a roof mounted ladder safety bracket that can be installed and uninstalled quickly without requiring the use of complex machinery.

These objectives and advantages are obtained by a roof mounted ladder safety bracket comprising a first plate, a second plate, a third plate, a first hinge and a second hinge. The first plate and the second plate are rotably coupled via the first hinge and the second plate and the third plate are rotably coupled via the second hinge. The first plate further comprises a plurality of arms extending therefrom, each of the plurality of arms comprising thereon at a distal end, a hook having an open end facing outward in a first direction, and the open end of the hook is configured to be temporarily attached to a leg of a ladder. The third plate further comprises at least one opening configured to enable the ladder safety bracket to be temporarily coupled to a roof structure.

Other objectives, features and advantages of the present invention will become apparent from the following detailed description and the accompanying drawings.

DETAILED DESCRIPTION

Figure 1:
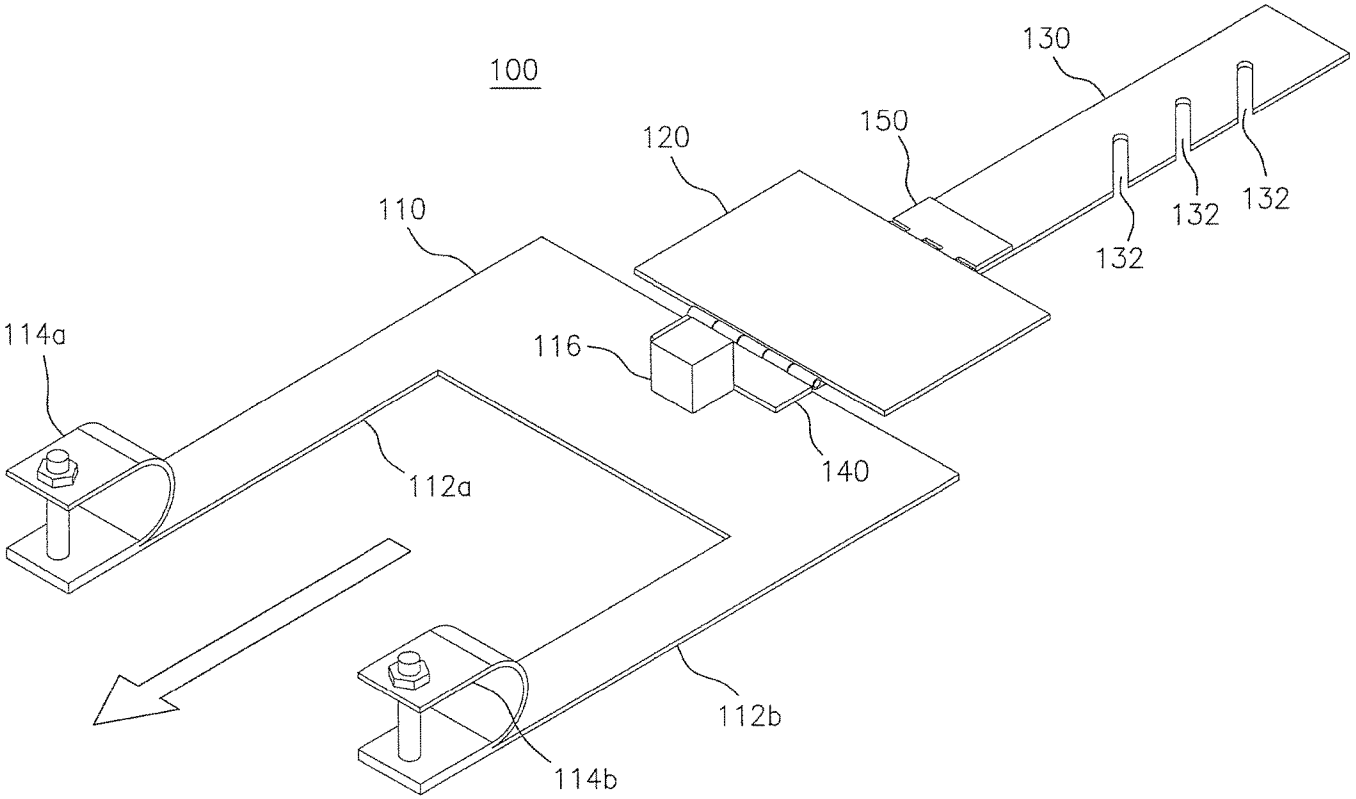
FIG. 1 is a perspective view of a schematic illustration the roof mounted ladder safety bracket in accordance with an embodiment of the present invention.

An exemplary embodiment of the roof mounted ladder safety bracket will now be described in more detail with reference to the figures wherein like reference numerals designate like or corresponding parts of the roof mounted ladder safety device throughout the several views.

Referring now to FIG. 1, a roof mounted ladder safety bracket 100 in accordance with an exemplary embodiment of the present invention comprises a first plate 110, a second plate 120 and a third plate 130. These plates may be made of any suitable metals (e.g., steel, aluminum, etc.), carbon fiber, or hardwood, but are not limited to such materials. The size, shape or thickness of the first, second and third plates may be modified from those shown and described herein, and the embodiments as shown in the accompanying figures and correspondingly described herein are not intended to limit the scope of the invention in any way. For example, in a preferred embodiment, all three plates are rectangular and made of 12 gauge steel.

As shown in FIG. 1, the first plate 110 comprises two arms, 112*a* and 112*b*, each extending in a first direction from a first side of the first plate 110. The first side of the first plate 110 is defined as the side of the first plate 110 that faces a ladder (not shown in FIG. 1). As further shown in FIG. 1, the first direction is defined by the arrow pointing from the first side of the first plate 110 toward the ladder (not shown in FIG. 1). The lengths and widths of the two extending arms 112*a* and 112*b* are identical and preferably dimensioned such that the length of the two arms 112*a* and 112*b* extends longer than the width of the first plate 110. For example, in one exemplary embodiment, the first plate 110 is a 10-inch by 4-inch 12 gauge steel plate and the two extending arms, 112*a* and 112*b*, are each 2 inches in width and 8 inches length.

FIG. 1 further illustrates each of the two extending arms 112*a* and 112*b* comprising at its distal end, a respective hooking mechanism (e.g., curved semi-open hooks 114*a* and 114*b*) for attaching the roof mounted ladder safety bracket 100 to a leg of a ladder (not shown in FIG. 1). In accordance with the present invention, the two hooks 114*a* and 114*b* are fixedly mounted to the distal end of each extending arm, respectively. The two hooks 114*a* and 114*b* may be fixedly mounted by, for example, means of gluing (e.g., hot-glue), screwing, clipping, or using any other suitable technique, onto the distal end of the respective arm. In a preferred embodiment of the present invention, the two hooks 114*a* and 114*b* are welded to the arms during a manufacturing process. An exemplary illustration of such hooks being engaged to a ladder will be described later in more detail with reference to FIG. 4.

The first plate 110 as shown in FIG. 1 further comprises a block 116 orthogonally protruding from a top surface of the first plate 110. In accordance with the present invention, the block 116 serves as a fixedly mounted base structure on the roof mounted ladder safety bracket 100 to which a force may be applied in a second direction in order to slidably remove the roof mounted ladder safety bracket 100 from a roof structure. The second direction as defined herein is directly opposite of the first direction indicated by the arrow in FIG. 1. An exemplary illustration of such removal process of the roof mounted ladder safety bracket 100 will be provided later with reference to FIG. 7.

In further accordance with the present invention, the block 116 is made of hard solid material (e.g., metal or hardwood) and securely attached to the top surface of the first plate 110. In a preferred embodiment, the block 116 is also welded to the first plate 110 during the manufacturing process. In other embodiments, the block 116 may be screwed, clipped or glued onto the first plate 110, or otherwise secured to the first plate 110 using known similar techniques. It is noted that the shape, position and even number of the block 116 on the roof mounted ladder safety bracket 100 are not limited to what is shown in FIG. 1. For example, in one embodiment, the block 116 may be positioned closer to the first side of the first plate 110 or offset from a centerline of the first plate 110. In an alternative embodiment, the first plate 110 may comprise thereon two blocks, each separately positioned near each of the extending arms 112*a* and 112*b*, and may have a round shape or a shape of a handle. It is further noted that positioning of the block 116 need not be limited to within the top surface of the first plate 110. In some embodiments, the block 116 (or blocks) used for removing the roof mounted ladder safety bracket 100 may be on the second plate 120 and/or the third plate 130. The foregoing embodiments as described herein are merely illustrative examples only and can be modified in the manufacturing process. There may be further embodiments differing from the embodiments as described and shown herein, but are still well within the scope or spirit of the present invention.

Still referring to FIG. 1, the second plate 120 is rotably coupled to the first plate via a first hinge 140. The first hinge 140 is coupled (or in a preferred embodiment, permanently welded) to a second side of the first plate 110, the second side of the first plate 110 being defined herein as the side that is opposite of the first side of the first plate 110. The first hinge 140 is also coupled (or in a preferred embodiment, permanently welded) to a first side of the second plate 120. The first side of the second plate 120 is defined herein as the side of the second plate 120 that is closer to the ladder (not shown in FIG. 1). The first hinge 140 may be made of any suitable metal, hardwood or other similar material. In a preferred embodiment, the first hinge is made of the same material as the first, second and third plates. In accordance with the present invention, the first hinge 140 as shown in FIG. 1, allows for a 0-to-360 degree rotation of the second plate 120 with respect to the first plate 110.

FIG. 1 further shows on a second side of the second plate 120, a second hinge 150 coupling the second plate 120 with the third plate 130, the second side of the second plate 120 being defined herein as the side of the second plate 120 that is opposite of the first side of the second plate 120. Similar to the first hinge 140, the second hinge 150 may be made of any suitable metal, hardwood or other similar material and allows for a 0-to-360 degree rotation of the third plate 130 with respect to the second plate 120. It is noted that the first hinge 140 and/or the second hinge 150 may be coupled to either top surfaces or bottom surfaces of the respective plates 110, 120 and 130.

Lastly, FIG. 1 shows the third plate 130 having a plurality of slanted openings 132, which provide open spaces to be used for temporarily mounting the roof mounted ladder safety bracket 100 to the roof structure. A detailed illustration of this feature will be described later with reference to FIG. 5.

It should be noted that the three plates 110, 120 and 130 and two hinges 140 and 150, as shown and described in FIG. 1, are not limited by the shape and size as depicted in the figures. For example, in one embodiment, the first hinge 140 and the second hinge 150 may be of identical material, shape and size. In an alternative embodiment, the first plate 110 and the second plate 120 may be equal in size. In a further embodiment, all three plates 110, 120 and 130 may be equal in size. In yet another embodiment, the second plate 120 may be omitted such that only the first hinge 140 may be used to rotably couple the first plate 110 to the third plate 130. There may be other embodiments of the roof mounted ladder safety brackets differing from the embodiments as described and shown herein, but are still within the scope or spirit of the present invention.

Figure 2:
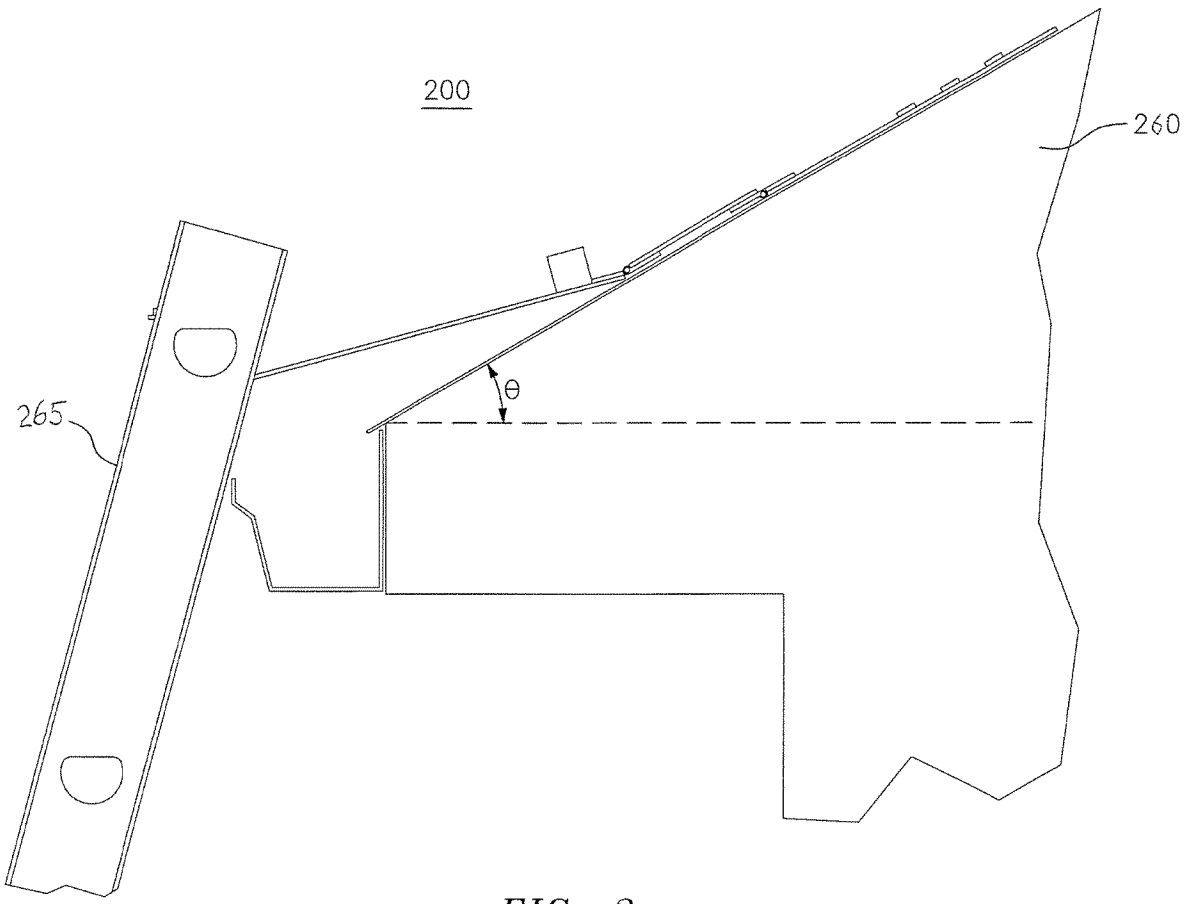
FIG. 2 is a perspective side view of the roof mounted ladder safety bracket being mounted on a roof and coupled to a ladder.

Referring now to FIG. 2, a perspective side view of a roof mounted ladder safety bracket 200, as also illustrated in reference to FIG. 1, being mounted on a roof structure 260 and coupled to a ladder 265 is illustrated. As shown in FIG. 2, the roof structure 210 is slanted at an angle θ. The two hinges of the roof mounted ladder safety bracket as described above in reference to FIG. 1 allow for adjustable and flexible application of the roof mounted ladder safety bracket to the roof structure 210 having any angle θ. It is noted that the two hinges of the roof mounted ladder safety bracket in accordance with the present invention allow for two degrees of freedom in mounting a roof mounted ladder safety bracket to various types, shapes and sizes of roof structures.

Figure 3:
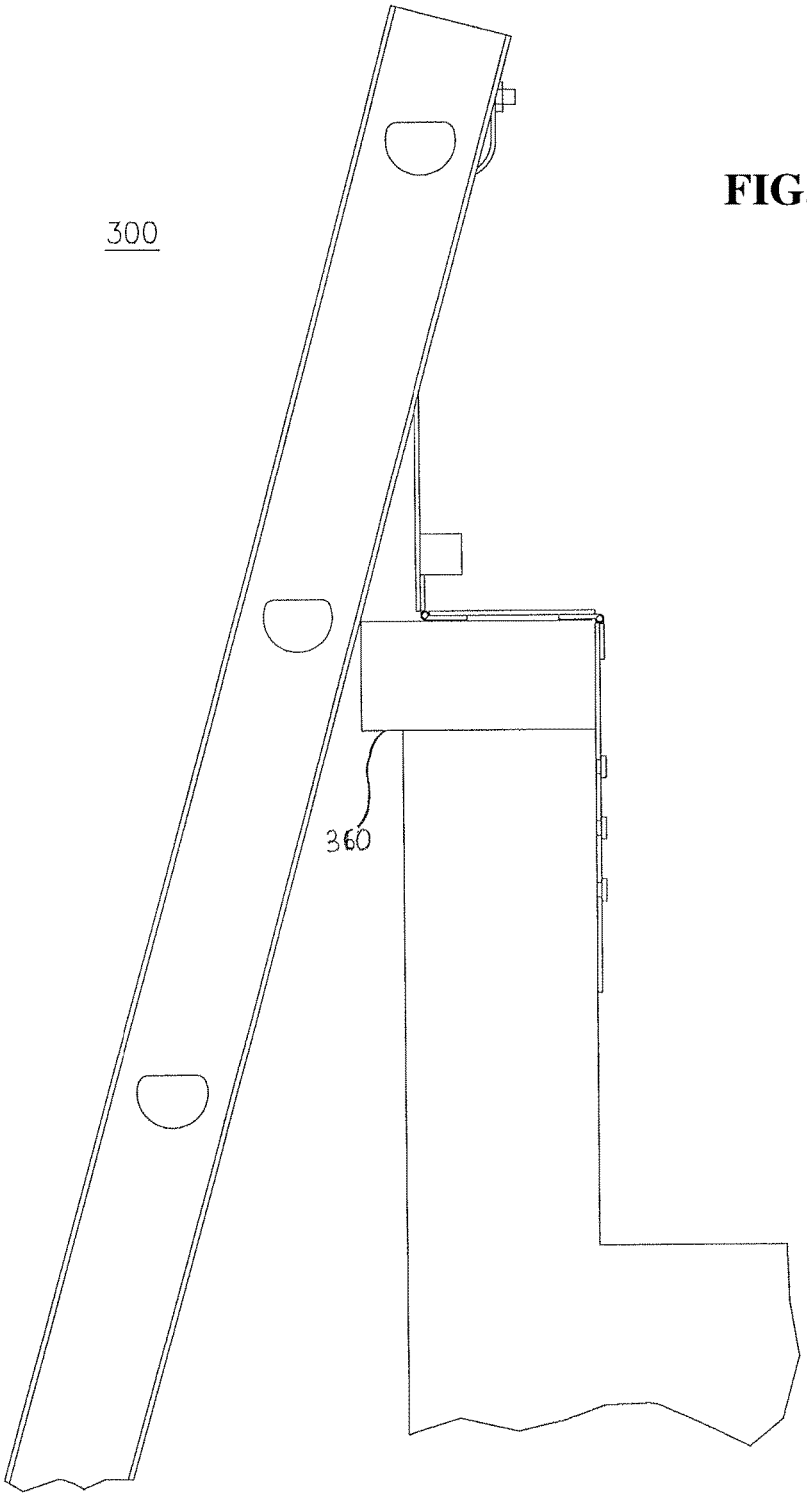
FIG. 3 is a perspective view showing an exemplary application of the roof mounted ladder safety bracket on a flat roof.

As further shown in FIG. 3, another exemplary roof mounted ladder safety bracket 300 of the present invention is mounted to a vertical roof structure 360. As shown in FIG. 3, a first hinge of the roof mounted ladder safety bracket allows for a near 90° support for attaching the roof mounted ladder safety bracket to a ladder and also for a near 270° support for the roof mounted ladder safety bracket hanging over a vertical edge of the roof structure 310.

Figure 4:
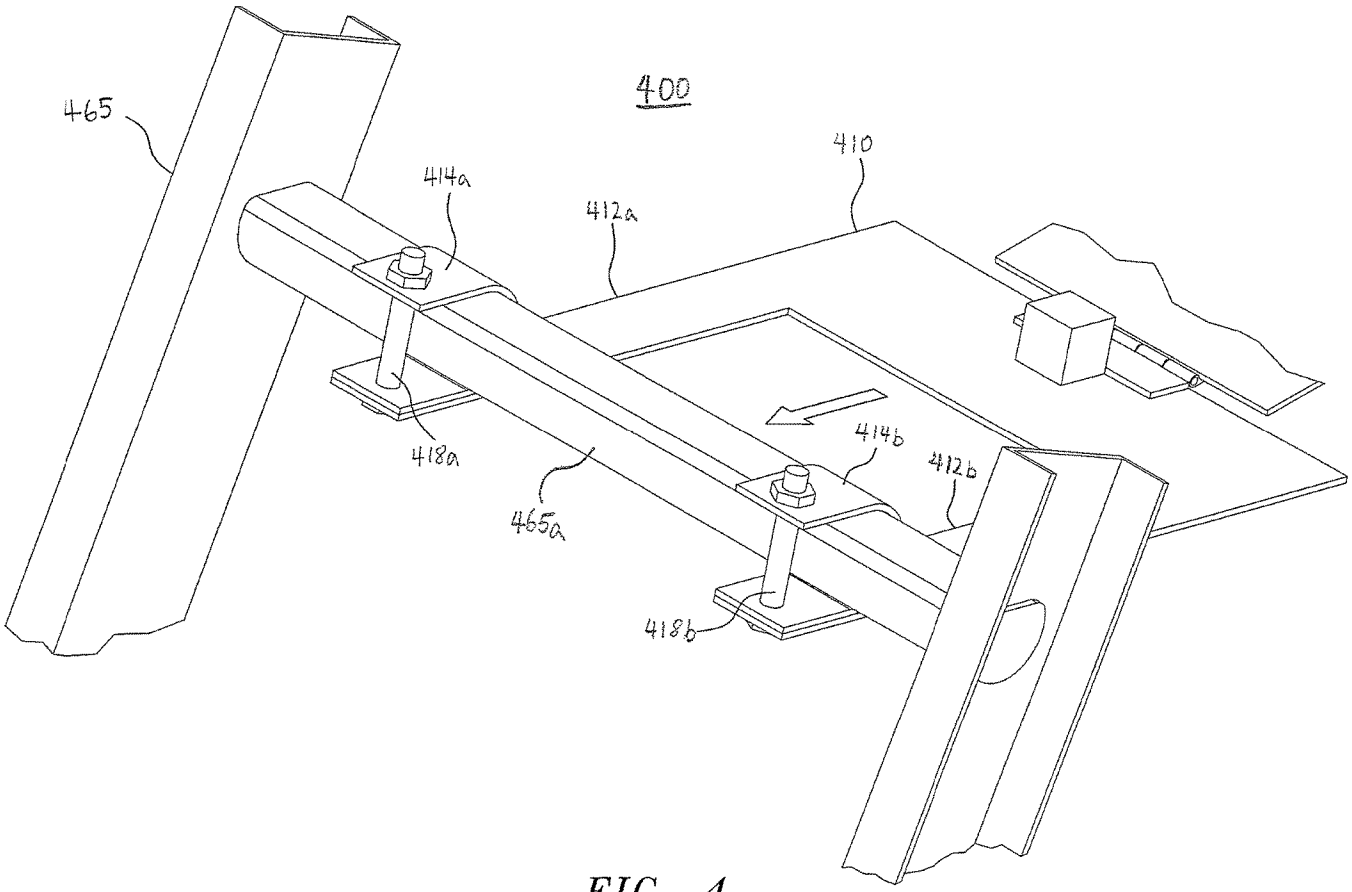
FIG. 4 is a detailed perspective view showing an exemplary mechanism for coupling the bracket to a ladder.

Referring now to FIG. 4, a detailed perspective view showing the locking mechanism for coupling roof mounted ladder safety bracket 400 to a ladder 465 is illustrated. In accordance with the present invention, the two hooks 414*a* and 414*b*, as also shown and described in reference to FIG. 1, are facing outward in the first direction, the first direction being defined by the arrow. As shown in FIG. 4, the two hooks 414*a* and 414*b* each comprise a curvature forming a space that is sufficient to enclose a leg 465*a* of the ladder 465. Once the leg 465*a* of the ladder 465 is slidably fitted inside the space created by the respective curvature, the roof mounted ladder safety bracket 400 is securely coupled to the ladder 465 via a locking mechanism.

The locking mechanism generally comprises a locking member that vertically penetrates a hole placed in an upper blade portion of a hook and a hole placed on the distal end an arm. The locking member is generally a metal or any hard-solid rod having a flat end. The hole in the upper blade portion of the hook and the hole on the distal end of the arm are generally vertically aligned and equal in size. Moreover, the two holes are smaller in area than the flat end of the locking member.

Referring back to FIG. 4, there is shown an exemplary locking mechanism as a nut-and-bolt system 418*a* and 418*b*. The system comprises a conventional bolt having a flat head and thread portion, being used as the locking member, and a nut. As shown in FIG. 4, the flat head of the bolt is larger in size than the size of holes created on hooks 414*a* and 414*b* and extending arms 412*a* and 412*b*. The thread portion of the bolt is long enough to perpendicularly traverse the entire height of the space created by the hooks 414*a* and 414*b* and the arms 412*a* and 412*b* via the holes. As further shown in FIG. 4, the nut locks onto the thread portion, thereby completing the locking mechanism.

It is noted that the locking mechanism as shown in reference to FIG. 4 is exemplary only and other types of locking mechanisms may be used. For example, an alternative embodiment may employ one or more nails having a length long enough to fully penetrate the space created by the hook and having a flat head that is larger in size than the size of the holes. It is further noted that the locking member need not be secured tightly from both ends of the holes. For the purposes of the present invention, the locking members only need to penetrate the full length of the space created by the curvature to lock the ladder with respect to the roof mounted ladder safety bracket.

Figure 5:
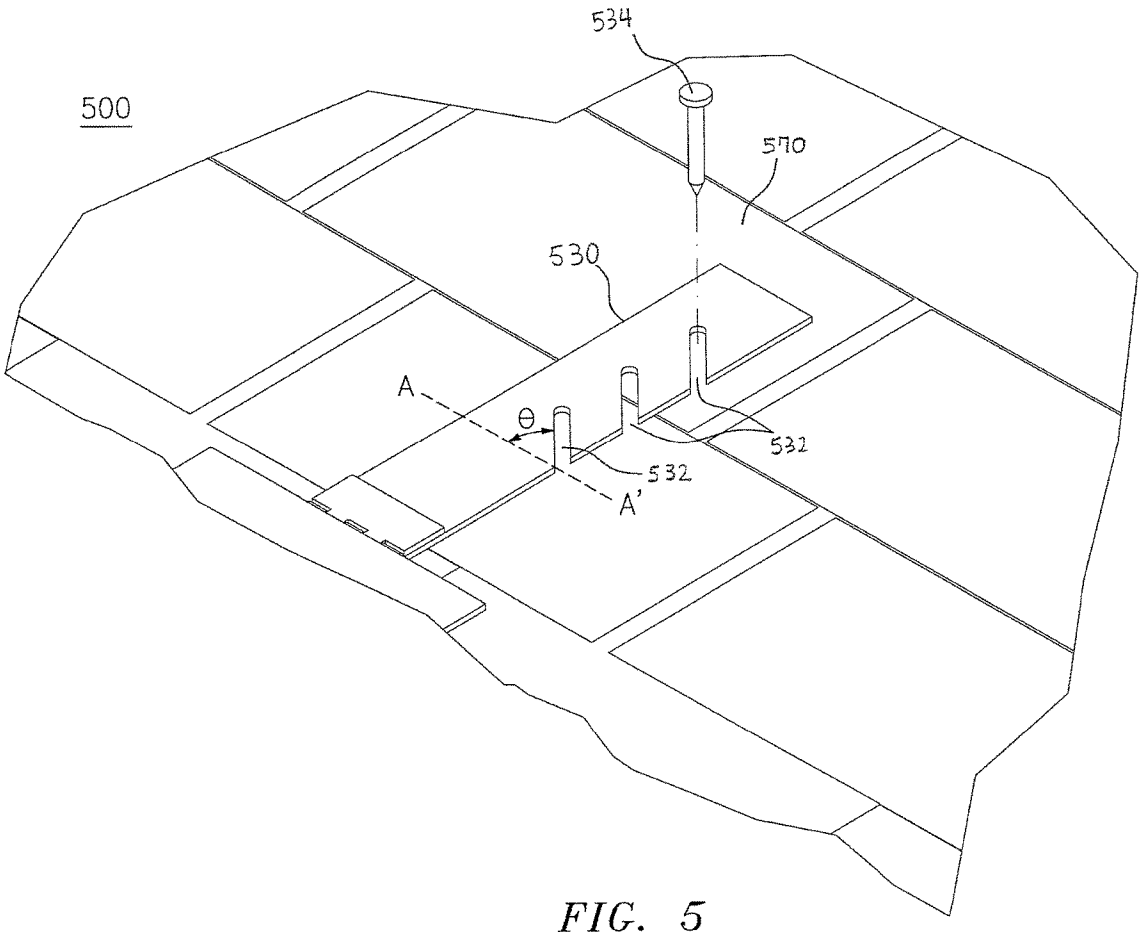
FIG. 5 is a detailed perspective view showing an exemplary mechanism for mounting the bracket onto a roof.

Referring now to FIG. 5, a detailed perspective view showing an exemplary illustration for mounting a roof mounted ladder safety bracket onto a roof structure is illustrated. As shown in FIG. 5, and also previously described in reference to FIG. 1, third plate 530 of roof mounted ladder safety bracket 500 comprises a plurality of slanted openings 532. In some embodiments, one slanted opening may suffice. The one or more slanted openings 532 are disposed within the third plate 530 at an angle such that once a nail 534 is hammered into a shingle 570 through the one or more slanted openings 532, the roof mounted ladder safety bracket 500 is fixed, at least temporarily, to the roof structure such that it cannot slide in a downward direction of the slanted roof structure. However, it should be noted that the slanted openings 532 allows for the roof mounted ladder safety bracket 500 to slide in an upward direction if enough force is applied.

In a preferred embodiment of the present invention, the one or more slanted openings 532 are angled at 45° with respect to the horizontal AA' axis shown in FIG. 5. Moreover, in the preferred embodiment, the one or more slanted opening 532 extend up to the middle of the third plate 530. It should be noted however that other variations are possible and are considered to be within the scope of the present invention as long as the angle between the slanted opening 532 and the horizontal AA' axis is not 0° or 90° and the slanted opening 532 does not fully cut across the width of the third plate 530.

Figure 6:
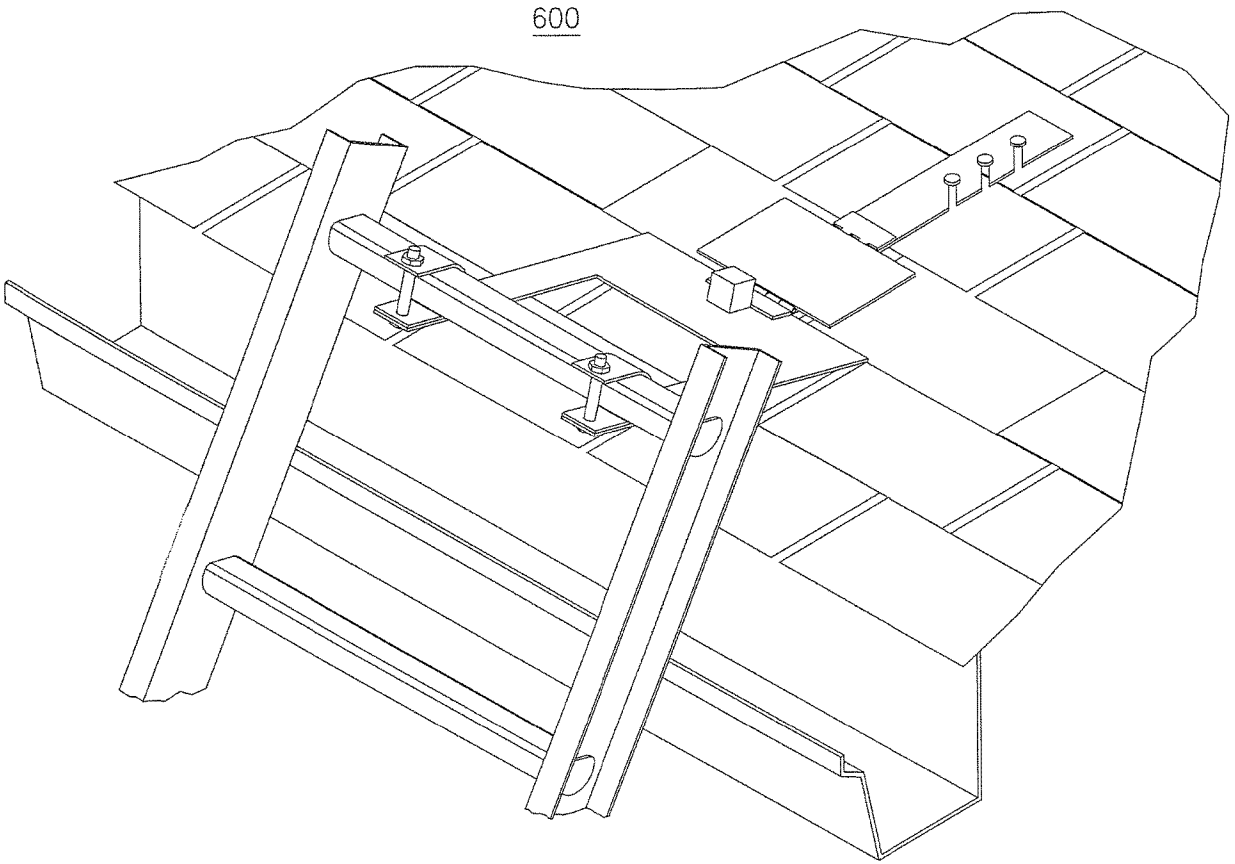
FIG. 6 is a perspective view of the roof mounted ladder safety bracket being fully engaged to a roof and a ladder.

Referring now to FIG. 6, there is shown a perspective view of a roof mounted ladder safety bracket 600 being fully engaged to a roof structure and a ladder. It should be noted that in FIG. 6, both the second and third plates of the roof mounted ladder safety bracket 600 are shown to be in contact with a surface of the roof structure. But depending on which height or on which leg of the ladder the roof mounted ladder safety bracket 600 is attached to, only the third plate may be in contact with the roof surface. Accordingly, as discussed above, roof mounted ladder safety brackets in accordance with the present invention, as also presently shown and described in reference to FIG. 6, can be securely mounted to roof structures of any angle.

Figure 7:
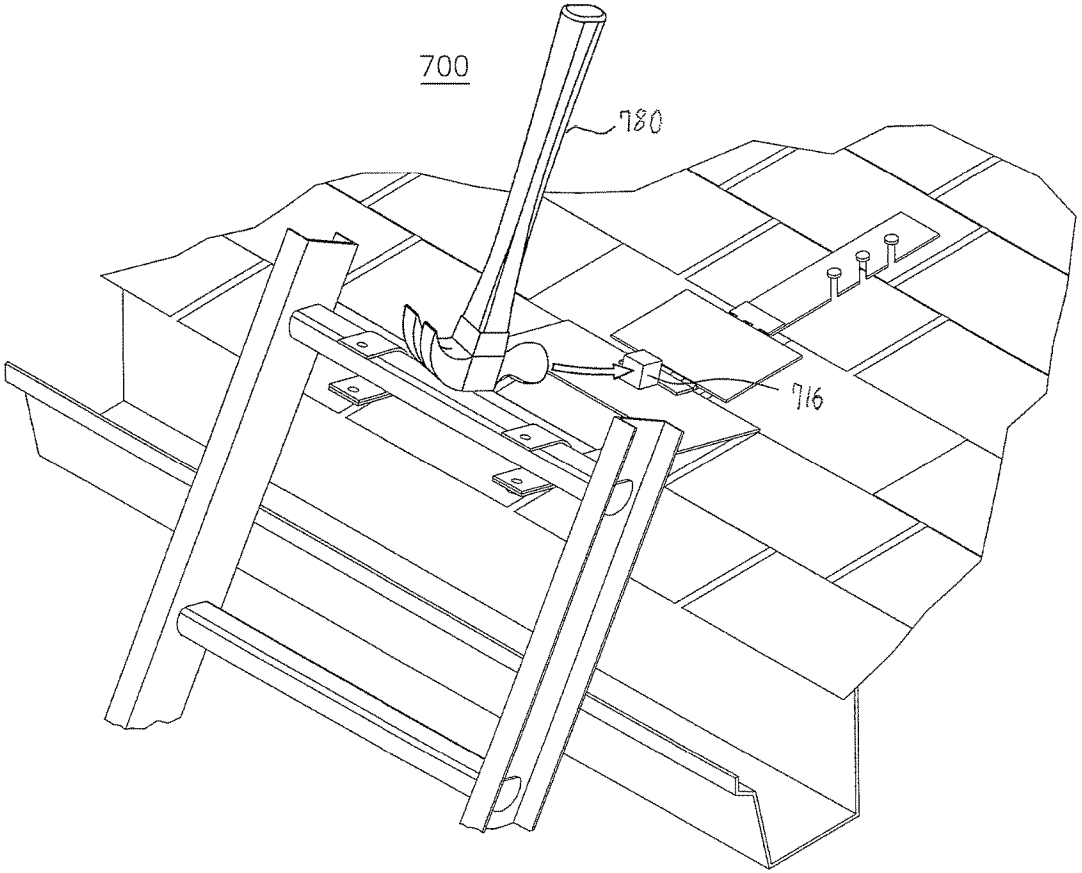
FIG. 7 is a detailed perspective view showing the removal process of the roof mounted ladder safety bracket.

Referring now to FIG. 7, an exemplary illustration of a removal process of a roof mounted ladder safety bracket 700 is shown. Once a task on the roof is completed, the removal process begins by removing the locking members from the holes. FIG. 7 shows the holes on hooks and extending arms of the roof mounted ladder safety bracket after locking members have been removed. In a preferred embodiment, the locking members do not require additional tools to disassemble. For example, in the embodiment as shown in FIG. 4, a user may simply unscrew the locking member using his hands. In an alternative embodiment where one or more nails are used as the locking member, the user may simply pull out the one or more nails from the holes.

Once the locking members are completely removed, the user may apply a force on a block 716 in a second direction as indicated by the arrow. As illustrated in FIG. 7, the user can, for example, use a hammer 780 to apply the force on the block 716. This allows for the roof mounted ladder safety bracket 700 to slide out upwardly at a direction defined by slanted openings 732. This removal process does not require the user to remove nails 734 on shingles 770. As discussed above, in alternative embodiments, the block 716 may have the shape of a handle and the user may push on it with bare hands in the second direction without using any tool.

In the foregoing description, certain terms have been used for brevity, clearness, and understanding. No unnecessary limitations are to be implied therefrom beyond the requirement of the prior art because such terms are used for descriptive purposes and are intended to be broadly construed. It is understood that while certain forms of the present invention have been illustrated and described herein, it is not to be limited to the specific forms or arrangements of parts described and shown. Modifications can be made in the structure of the roof mounted ladder safety bracket without departing from the scope and purview of the invention as defined in the appended claims.

The invention claimed is:

1. A ladder safety bracket comprising:

a plurality of plates; and a plurality of hinges for rotably coupling the plurality of plates, wherein one of the plurality of plates comprises:

a plurality of arms extending therefrom, each of the plurality of arms having a hook at a distal end, the hook facing outward in a first direction and adapted to receive a rung of a ladder; and an orthogonally protruding block welded thereto, wherein another one of the plurality of plates comprises:

a plurality of opening slits being oriented at an oblique angle and adapted to receive at least one nail for preventing the bracket from sliding on a roof in the first direction, and wherein the block is adapted to receive a force in a second direction, the second direction being opposite to the first direction and the force enabling detachment of the bracket from the roof without removing the at least one nail received in the plurality of opening slits.

2. The ladder safety bracket of claim 1, wherein the hook is formed by an upper blade and a lower blade; and wherein the upper blade and the lower blade respectively comprises a hole that are vertically aligned.

3. The ladder safety bracket of claim 2, further comprising:

a locking mechanism for securing the rung of the ladder within the hook, wherein the locking mechanism comprises a locking member that penetrates the holes.

4. The ladder safety bracket of claim 3, wherein the locking member is a bolt and the locking mechanism is a bolt-and-nut system.

5. The ladder safety bracket of claim 3, wherein the locking member further comprises a flat end having a surface area larger than at least one of the holes.

6. The ladder safety bracket of claim 1, wherein the plurality of hinges are configured to enable a respective 360 degree rotation of the plates with respect to each other.

7. A ladder safety bracket comprising:

a first plate;

a second plate;

a third plate;

a first hinge for rotably coupling the first plate and the second plate to enable a first 360 degree freedom of rotation of the first plate and the second plate with respect to each other; and a second hinge for rotably coupling the second plate and the third plate to enable a second 360 degree freedom of rotation of the second plate and the third plate with respect to each other, wherein the first plate comprises a plurality of arms extending therefrom, each of the plurality of arms having a hook at a distal end, the hook facing outward in a first direction and adapted to receive a rung of a ladder, and wherein the third plate is adapted to fasten to a surface of a roof via a plurality of opening slits formed thereon, and wherein the first and second freedom of rotations accommodate mounting of the bracket to roofs angled at a range of angles.

8. The ladder safety bracket of claim 7, wherein at least one of the first, second and third plate comprises a block orthogonally protruding therefrom.

9. The ladder safety bracket of claim 7, wherein the hook is formed by an upper blade and a lower blade; and wherein the upper blade and the lower blade respectively comprises a hole that are vertically aligned.

10. The ladder safety bracket of claim 9, further comprising:

a locking mechanism for securing the rung of the ladder within the hook, wherein the locking mechanism comprises a locking member that penetrates the holes.

11. A method of using a ladder safety bracket, the bracket comprising a first plate, a second plate, a third plate, a first hinge for rotably coupling the first plate and the second plate and a second hinge for rotably coupling the second plate and the third plate, the method comprising:

fastening, via a plurality of opening slits formed on the third plate, the bracket to a surface of a roof; and receiving, via a plurality of arms extending from the first plate, each of the plurality of arms having a hook at a distal end, the hook facing outward in a first direction, a rung of a ladder, wherein the first hinge enables a first 360 degree freedom of rotation between the first plate and the second plate and the second hinge enables a second 360 degree freedom of rotation between the second plate and the third plate, wherein the first and second freedom of rotations accommodate mounting of the bracket to roofs angled at a range of angles.

12. The method of claim 11, wherein the hook is formed by an upper blade and a lower blade, each blade comprising a hole that are vertically aligned; and wherein receiving the rung of the ladder further comprises:

using a locking mechanism to secure the rung of the ladder within the hook.

13. The method of claim 12, wherein fastening the bracket to the surface of the roof further comprises receiving at least one nail through the plurality of opening slits.

14. The method of claim 13, further comprising:

providing an orthogonally protruding block on the first plate, wherein the block is adapted to receive a force in a second direction, the second direction being opposite to the first direction and the force enabling detachment of the bracket from the surface roof without removing the at least one nail received in the plurality of opening slits.

15. The method of claim 14, further comprising:

applying a hammering force on the block in the second direction to slidably remove the bracket from the surface of the roof without removing the at least one nail received in the plurality of opening slits.

* * * * *